US010218047B2

(12) United States Patent
Nakamoto et al.

(10) Patent No.: US 10,218,047 B2
(45) Date of Patent: Feb. 26, 2019

(54) PLANAR ANTENNA APPARATUS AND SUPPORT OF PLANAR ANTENNA APPARATUS

(71) Applicant: Kabushiki Kaisha Toshiba, Minato-ku (JP)

(72) Inventors: Masaki Nakamoto, Suginami (JP); Toshiyuki Mukai, Hino (JP); Noriyuki Saito, Kawasaki (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 220 days.

(21) Appl. No.: 15/417,935

(22) Filed: Jan. 27, 2017

(65) Prior Publication Data

US 2017/0222298 A1 Aug. 3, 2017

(30) Foreign Application Priority Data

Feb. 1, 2016 (JP) ..... 2016-017549

(51) Int. Cl.
*H01Q 1/12* (2006.01)
*H01Q 3/08* (2006.01)
*H01Q 9/04* (2006.01)

(52) U.S. Cl.
CPC ..... *H01Q 1/1264* (2013.01); *H01Q 1/1207* (2013.01); *H01Q 3/08* (2013.01); *H01Q 9/0414* (2013.01)

(58) Field of Classification Search
CPC .. H01Q 3/02; H01Q 3/08; H01Q 3/10; H01Q 1/125; H01Q 1/1264
See application file for complete search history.

(56) References Cited

U.S. PATENT DOCUMENTS 5,432,524 A * 7/1995 Sydor ..... H01Q 1/3275 343/765
2007/0001920 A1* 1/2007 Webb ..... H01Q 1/08 343/766
2014/0299734 A1* 10/2014 Nielsen ..... H01Q 1/005 248/560

FOREIGN PATENT DOCUMENTS

JP 2008-277984 11/2008

* cited by examiner

*Primary Examiner* — Daniel Munoz
(74) *Attorney, Agent, or Firm* — Oblon, McClelland, Maier & Neustadt, L.L.P.

(57) ABSTRACT

According to one embodiment, a planar antenna apparatus includes a support including: a support main body, and three or more support legs extending from the support main body, a first movable unit rotatably supported around a first axis with respect to the support, a second movable unit rotatably supported around a second axis with respect to the first movable unit, the second axis extending along a main surface of the first movable unit, a third movable unit rotatably supported around a third axis with respect to the second movable unit, the third axis extending along a thickness direction of the second movable unit, an antenna unit supported by the third movable unit, and a connection wire electrically connecting the first movable unit and the third movable unit.

13 Claims, 12 Drawing Sheets

PLANAR ANTENNA APPARATUS AND SUPPORT OF PLANAR ANTENNA APPARATUS

CROSS-REFERENCE TO RELATED APPLICATION

This application claims priority from Japanese Patent Application No. 2016-017549 filed on Feb. 1, 2016, the contents of which are incorporated herein by reference in their entirety.

FIELD

Embodiments described herein relate generally to a planar antenna apparatus.

BACKGROUND

A communication system which communicates via a communications satellite is not easily affected by a disaster such as an earthquake or the like. Thus, various studies are being conducted due to the fact that the above-described communication system is usable even during a disaster.

As an example of this type of communication system, there is a very small aperture terminal (VSAT) system.

In a VSAT system, a planar antenna apparatus which conducts communication control with a communications satellite has, for example, a support placed on an installation surface, first to third movable units rotatable with respect to each other, and an antenna unit supported by the third movable unit. A position of the antenna unit can be adjusted by rotation of the first to third movable units.

It is desirable that the planar antenna apparatus, because of being used outdoors, be stably installed without being inclined under the influence of wind or the like.

DETAILED DESCRIPTION

Figure 1:
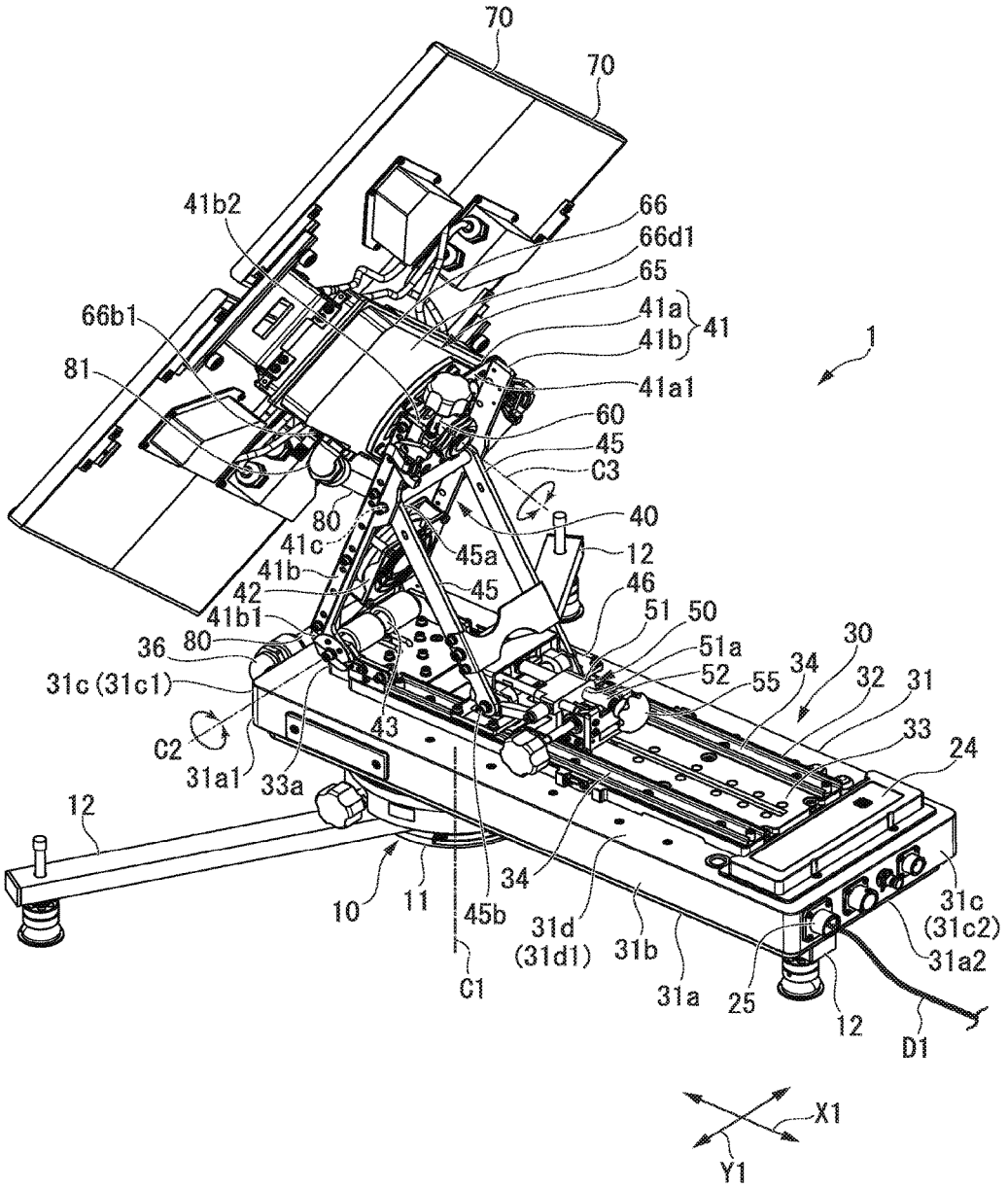
FIG. 1 is a perspective view showing a planar antenna apparatus of one embodiment viewed from the rear side.

According to one embodiment, a planar antenna apparatus includes: a support including: a support main body; and three or more support legs extending from the support main body, a first movable unit rotatably supported around a first axis with respect to the support, a second movable unit rotatably supported around a second axis with respect to the first movable unit, the second axis extending along a main surface of the first movable unit, a third movable unit rotatably supported around a third axis with respect to the second movable unit, the third axis extending along a thickness direction of the second movable unit, an antenna unit supported by the third movable unit, and a connection wire electrically connecting the first movable unit and the third movable unit, wherein, when an elevation angle of the antenna unit is set to a minimum use angle, a center of gravity of an entire body including the support, the first movable unit, the second movable unit, the third movable unit, the antenna unit, and the connection wire is aligned with a center of gravity of a polygon which connects a grounding point of the three or more support legs when viewed perpendicular to an installation surface with which the support legs are in contact.

Hereinafter, a planar antenna apparatus of an embodiment will be described with reference to the drawings. Moreover, in the following description, the configurations having the same or similar functions will be assigned by the same reference numerals. Redundant descriptions may be omitted.

First Embodiment

Figure 2:
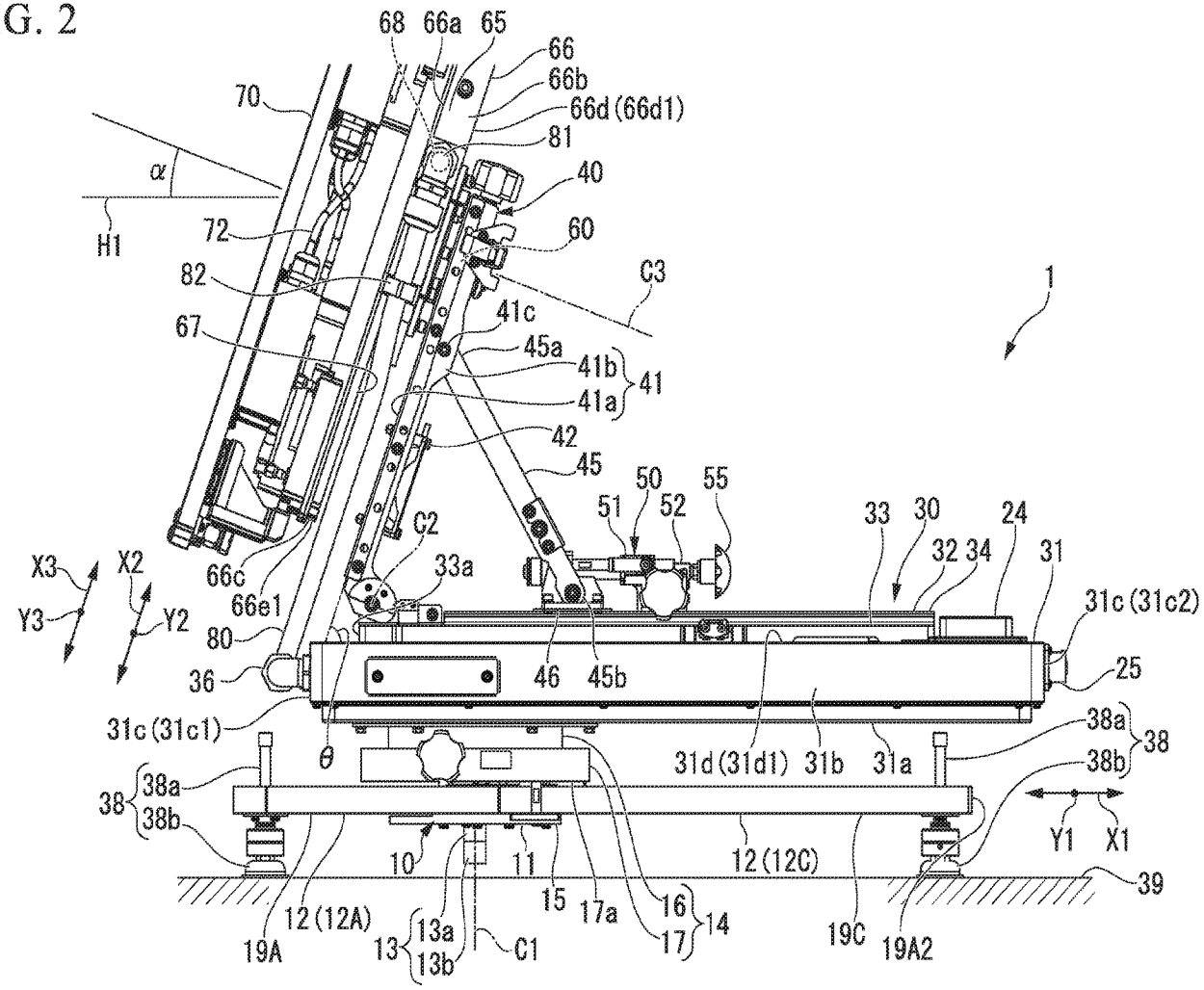
FIG. 2 is a side view partially showing a planar antenna apparatus of one embodiment.

FIG. 1 is a perspective view showing a planar antenna apparatus 1 of the present embodiment viewed from the rear side. FIG. 2 is a side view partially showing the planar antenna apparatus 1.

As shown in FIGS. 1 and 2, the planar antenna apparatus 1 includes a support 10, a first movable unit 30, a second movable unit 40, a third movable unit 65, an antenna unit 70, and a connection cable 80 (a connection wire).

Figure 4:
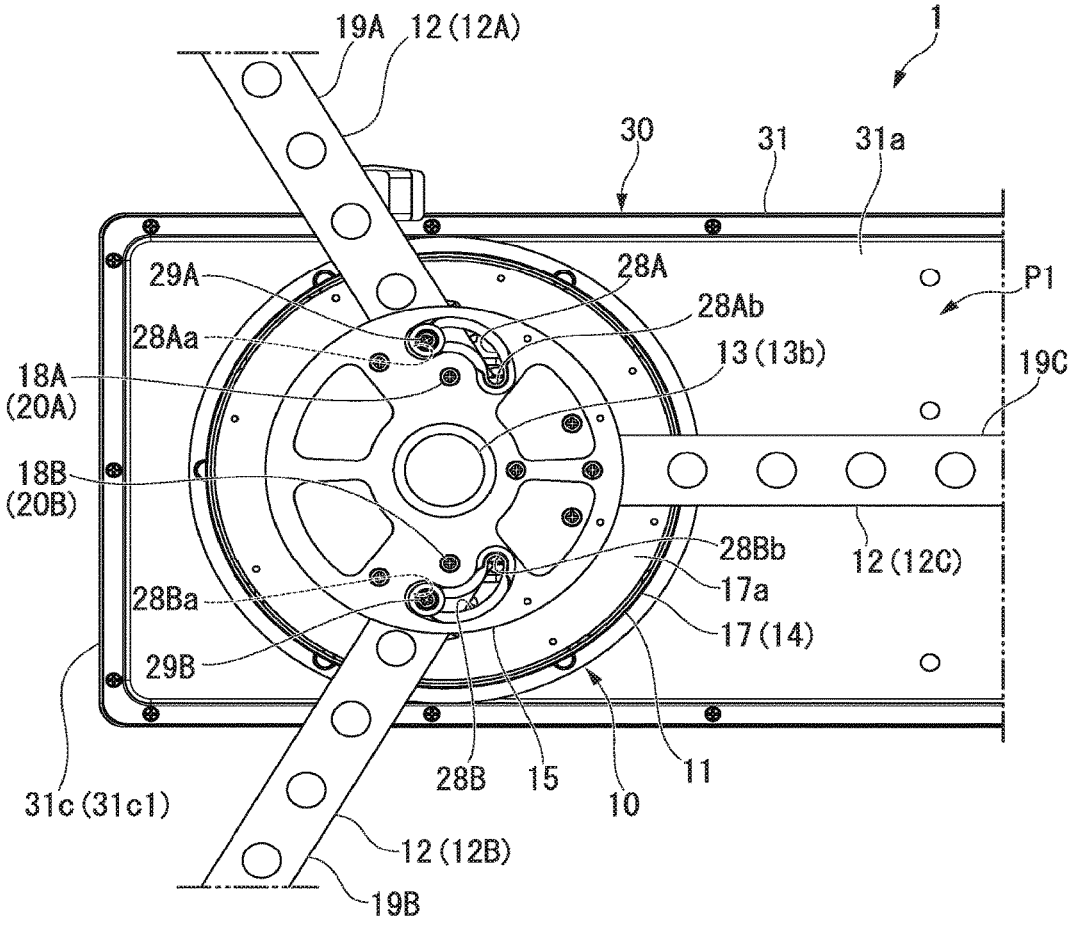
FIG. 4 is a plan view showing a support in a state where support legs protrude in a planar antenna apparatus of one embodiment.

As shown in FIGS. 2 and 4, the support 10 has a support main body 11, three support legs 12 (12A to 12C), and a tentative supporting protrusion 13.

The support main body 11 includes a base pedestal 14 and a bottom disc 15 provided to be spaced from the base pedestal 14.

The base pedestal 14 includes a columnar base 16 attached to the first movable unit 30 and a columnar main pedestal 17 installed to be continuous with the base 16. A direction of a central axis of the main pedestal 17 is aligned with a direction of a central axis of the base 16. An outer diameter of the main pedestal 17 is greater than an outer diameter of the base 16. The direction of the central axis of the main pedestal 17 is the same as a thickness direction of the main pedestal 17.

Figure 5:
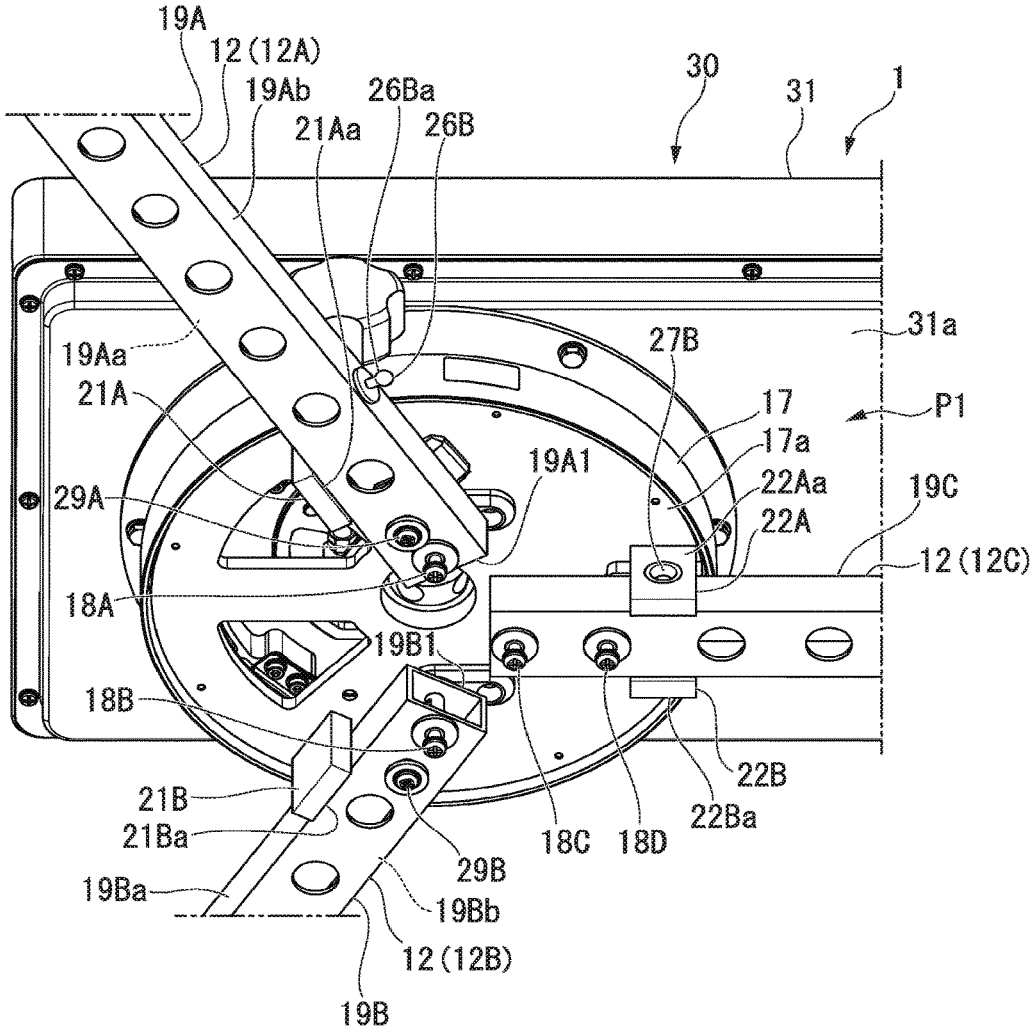
FIG. 5 is a perspective view showing an internal structure of a support in a state where support legs protrude in a planar antenna apparatus of one embodiment.

FIG. 5 is a perspective view showing the support 10 in a state where the bottom disc 15 is detached.

As shown in FIG. 5, a first rotating shaft 18A and a second rotating shaft 18B are provided to protrude in the thickness direction of the main pedestal 17 at an outer surface 17*a* of the main pedestal 17.

The first rotating shaft 18A rotatably supports a base end 19A1 of a leg member 19A of the first rotating support leg 12A. The second rotating shaft 18B rotatably supports a base end 19B1 of a leg member 19B of the second rotating support leg 12B.

Distal ends of the first rotating shaft 18A and the second rotating shaft 18B are respectively fixed to the bottom disc 15 at fixers 20A and 20B (see FIG. 4).

At the outer surface 17*a* of the main pedestal 17, a first outside restricting protrusion 21A, a first inside restricting protrusion 22A, a second outside restricting protrusion 21B, and a second inside restricting protrusion 22B are provided to protrude in the thickness direction of the main pedestal 17. The first outside restricting protrusion 21A, the first inside restricting protrusion 22A, the second outside restricting protrusion 21B, and the second inside restricting protrusion 22B are formed in plate shapes.

Figure 6:
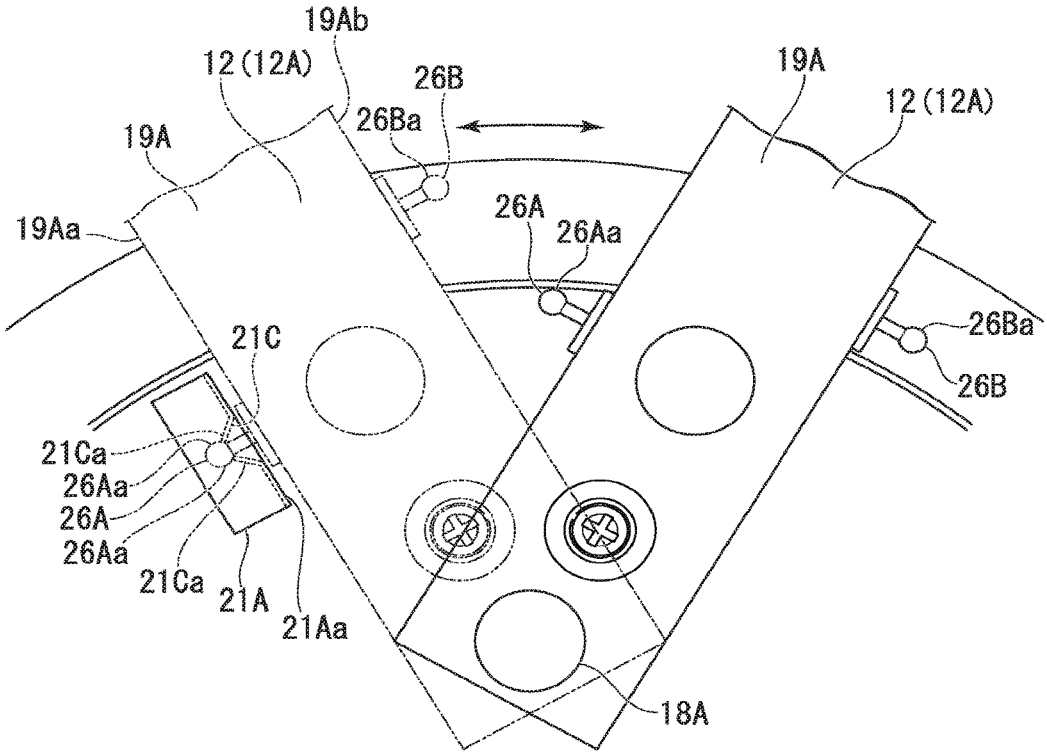
FIG. 6 is a plan view showing a structure of a locking mechanism of a planar antenna apparatus of one embodiment.

As shown in FIG. 6, a receiving recess 21C which receives an outer side locking protrusion 26A provided at the leg member 19A of the first rotating support leg 12A is formed at an inner surface 21Aa of the first outside restricting protrusion 21A. An elastically deformable locking piece 21Ca (a lock receiver) to which a locking protrusion tip 26Aa (a locking portion) which is an end of the outer side locking protrusion 26A is releasably locked is formed inside the receiving recess 21C.

The outer side locking protrusion 26A and the locking piece 21Ca constitute a first protrusion retention mechanism which retains the first rotating support leg 12A at a protrusion position P1.

As shown in FIG. 5, a receiving recess 27B which receives an inner side locking protrusion 26B provided at the leg member 19A of the first rotating support leg 12A is formed at an inner surface 22Aa of the first inside restricting protrusion 22A. An elastically deformable locking piece (a lock receiver) (not shown in the figure) to which a locking protrusion tip 26Ba (a locking portion) which is an end of the inner side locking protrusion 26B is releasably locked is formed inside the receiving recess 27B.

The inner side locking protrusion 26B and a locking piece of the receiving recess 27B constitute a first retraction retention mechanism which retains the first rotating support leg 12A at a retraction position P2.

Similar to the first outside restricting protrusion 21A, a receiving recess (not shown in the figure) which receives an outer side locking protrusion (not shown in the figure) provided at the leg member 19B of the second rotating support leg 12B is formed at an inner surface 21Ba of the second outside restricting protrusion 21B. An elastically deformable locking piece (a lock receiver) to which a locking protrusion tip (a locking portion) which is an end of the outer side locking protrusion of the second rotating support leg 12B is releasably locked is formed inside the receiving recess.

The outer side locking protrusion and the locking piece constitute a second protrusion retention mechanism which retains the second rotating support leg 12B at the protrusion position P1.

Similar to the first inside restricting protrusion 22A, a receiving recess (not shown in the figure) which receives an inner side locking protrusion (not shown in the figure) provided at the leg member 19B of the second rotating support leg 12B is formed at the inner surface 21Ba of the second inside restricting protrusion 22B. An elastically deformable locking piece (a lock receiver) (not shown in the figure) to which a locking protrusion tip (a locking portion) which is an end of the inner side locking protrusion of the second rotating support leg 12B is releasably locked is formed inside the receiving recess.

The inner side locking protrusion and the locking piece constitute a second retraction retention mechanism which retains the second rotating support leg 12B at the retraction position P2.

As shown in FIG. 4, the bottom disc 15 is formed in a disc shape. A central axis of the bottom disc 15 is aligned with the central axis of the main pedestal 17. An outer diameter of the bottom disc 15 is smaller than the outer diameter of the main pedestal 17. The bottom disc 15 is provided to be spaced from the main pedestal 17 in the thickness direction of the main pedestal 17. The bottom disc 15 is at a position facing the outer surface 17*a* of the main pedestal 17.

A first guide hole 28A in a slit shape along a circular arc centered on the first rotating shaft 18A and a second guide hole 28B in a slit shape along a circular arc centered on the second rotating shaft 18B are formed at the bottom disc 15.

The first guide hole 28A is formed so that a first guide protrusion 29A provided at the leg member 19A of the first rotating support leg 12A can be entered therein.

An outer end 28Aa which is one end of the first guide hole 28A is in contact with the first guide protrusion 29A when the first rotating support leg 12A is at the protrusion position P1 (see FIGS. 1 to 5) and can restrict movement of the first rotating support leg 12A in an opening direction (counterclockwise around the first rotating shaft 18A in FIG. 4).

An inner end 28Ab which is the other end of the first guide hole 28A is in contact with the first guide protrusion 29A when the first rotating support leg 12A is at the retraction position P2 (see FIGS. 8 to 10) and can restrict the movement of the first rotating support leg 12A in a closing direction (clockwise around the first rotating shaft 18A in FIG. 4).

The second guide hole 28B is formed so that a second guide protrusion 29B provided at the leg member 19B of the second rotating support leg 12B can be entered therein.

An outer end 28Ba which is one end of the second guide hole 28B is in contact with the second guide protrusion 29B when the second rotating support leg 12B is at the protrusion position P1 and can restrict movement of the second rotating support leg 12B in an opening direction (clockwise around the second rotating shaft 18B in FIG. 4).

An inner end 28Bb which is the other end of the second guide hole 28B is in contact with the second guide protrusion 29B when the second rotating support leg 12B is at the retraction position P2 and can restrict the movement of the second rotating support leg 12B in a closing direction (counterclockwise around the second rotating shaft 18B in FIG. 4).

Figure 7:
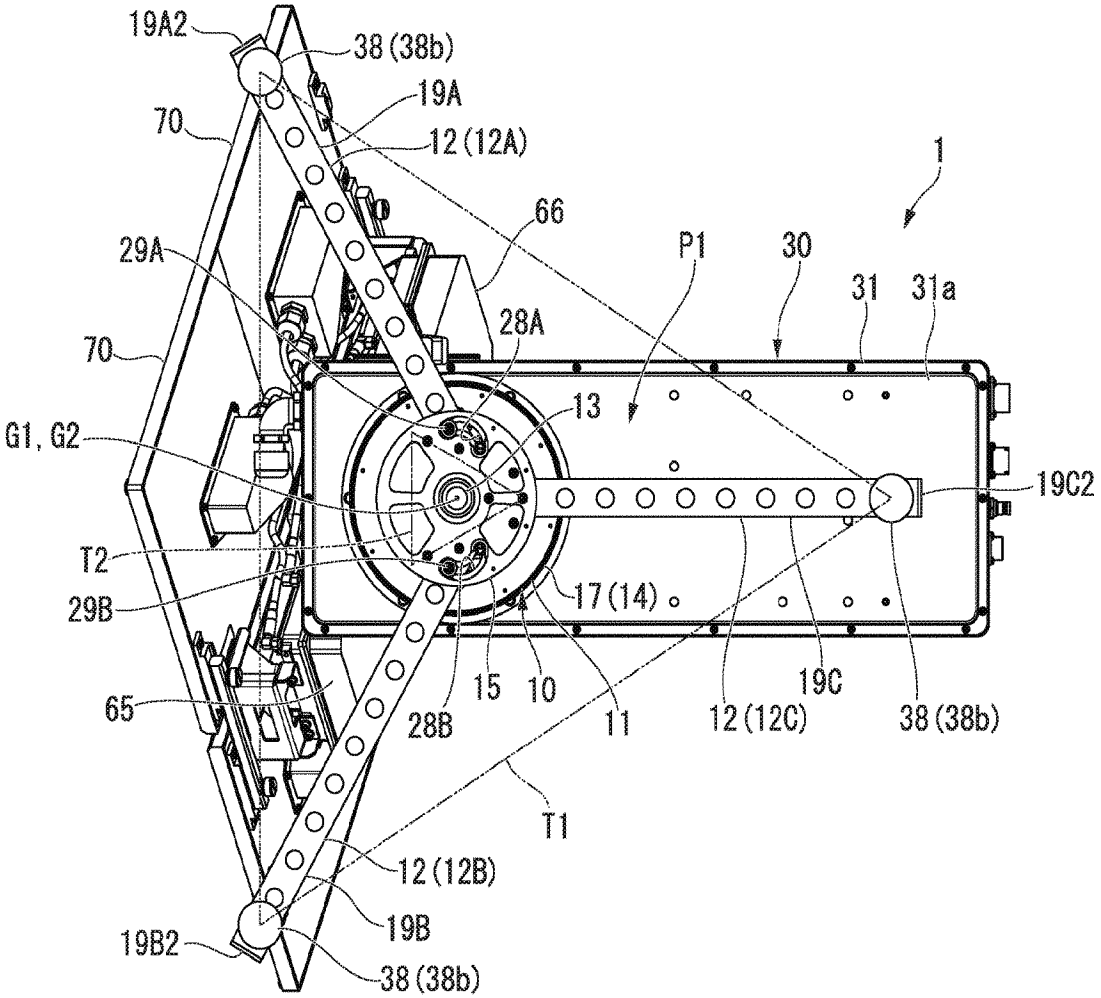
FIG. 7 is a plan view showing a state where support legs protrude in a planar antenna apparatus of one embodiment.

As shown in FIGS. 2 and 7, the three support legs 12 extend parallel to the outer surface 17*a* of the main pedestal 17 from the support main body 11.

Of the three support legs 12, the first rotating support leg 12A includes the leg member 19A which extends in a straight line and a grounding member 38 provided at a distal end 19A2 of the leg member 19A. The second rotating support leg 12B includes the leg member 19B which extends in a straight line and a grounding member 38 provided at a distal end 19B2 of the leg member 19B. A fixed support leg 12C includes a leg member 19C which extends in a straight line and a grounding member 38 provided at a distal end 19C2 of the leg member 19C.

The leg members 19A, 19B, and 19C are formed of, for example, a metal (an aluminum alloy, etc.), a resin or the like. Cross-sectional shapes of the leg members 19A, 19B, and 19C perpendicular to a length direction are, for example, a rectangle.

As shown in FIG. 2, the grounding member 38 includes a shaft 38*a* in a thickness direction of the leg members 19A, 19B and 19C (a vertical direction in FIG. 2) and a grounding body 38*b* provided at one end of the shaft 38*a* (a lower end in FIG. 2). The grounding body 38*b* can be formed of, for example, a soft resin.

A bottom surface of the grounding body 38*b* in FIG. 2 is a grounding point in contact with an installation surface 39 on which the planar antenna apparatus 1 is installed.

As shown in FIG. 5, the fixed support leg 12C is attached to the main pedestal 17 by fixing tools 18C and 18D.

As shown in FIG. 6, the outer side locking protrusion 26A and the inner side locking protrusion 26B are respectively formed at an outer surface 19Aa and an inner surface 19Ab of the leg member 19A of the first rotating support leg 12A.

As shown in FIG. 5, similar to the first rotating support leg 12A, an outer side locking protrusion (not shown in the figure) and an inner side locking protrusion (not shown in the figure) are respectively provided at an outer surface 19Ba and an inner surface 19Bb of the leg member 19B of the second rotating support leg 12B.

A first axis C1 which is a rotation axis of the first movable unit 30 with respect to the support 10 is parallel to a central axis direction of the main pedestal 17. The first axis C1 extends in a thickness direction of the support 10 (the support main body 11).

Also, the number of support legs 12 can be any number of three or more. Accordingly, the number of support legs 12 may be three or four or more.

As shown in FIG. 2, the tentative supporting protrusion 13, for example, in a columnar shape, is provided to protrude in a thickness direction of the main pedestal 17 at a center of the outer surface 17*a* of the main pedestal 17. The tentative supporting protrusion 13 has a protrusion main body 13*a* and a grounding body 13*b* provided at a distal end of the protrusion main body 13*a*. The grounding body 13*b* can be formed of, for example, a soft resin.

The planar antenna apparatus 1 can be switchable between the protrusion position P1 in which the support legs 12 protrude from the first movable unit 30 (see FIGS. 1 to 5) and the retraction position P2 in which the support legs 12 are disposed in a contour of the first movable unit 30 (see FIGS. 8 to 10) when viewed in the direction parallel to the first axis C1.

Figure 3:
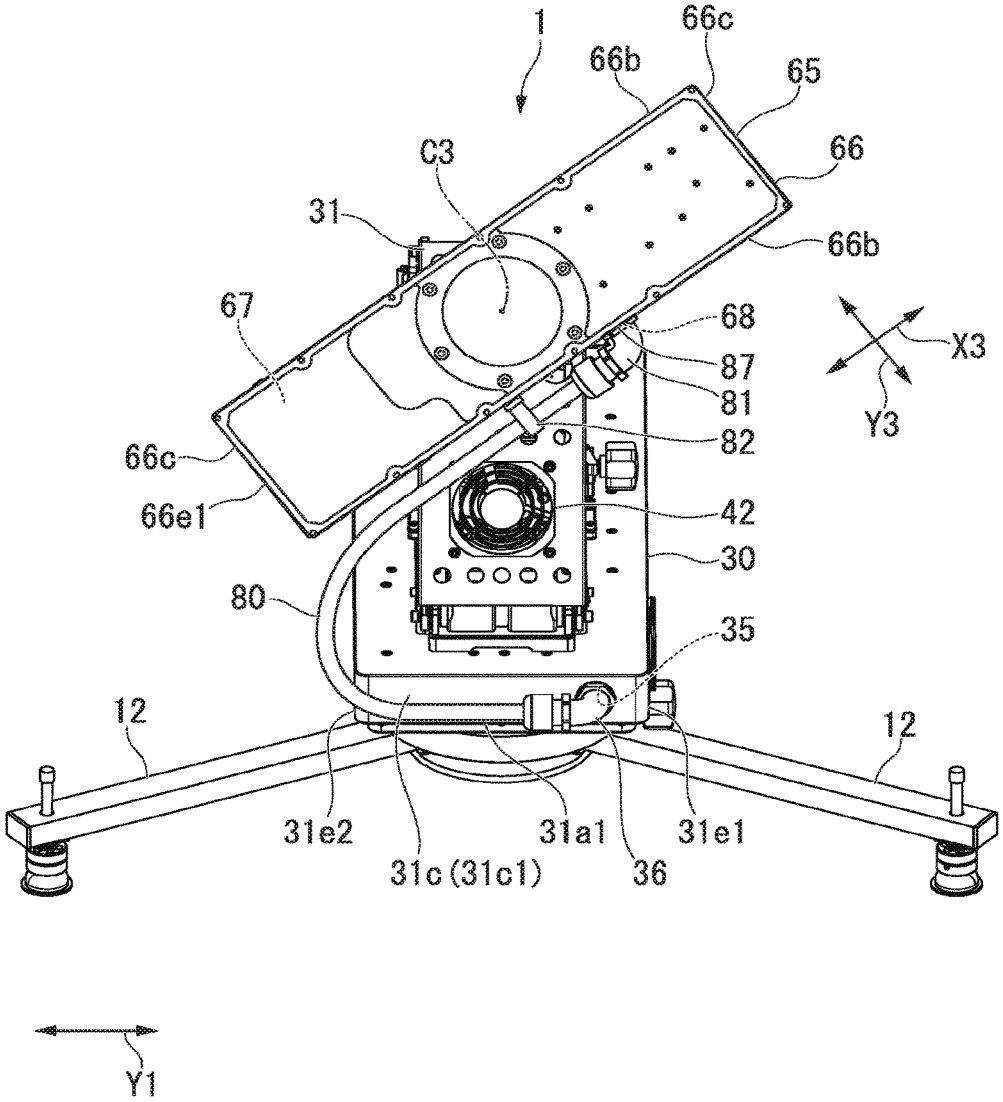
FIG. 3 is a perspective view showing a planar antenna apparatus of one embodiment viewed from the front side in a state where members such as an antenna unit or the like are removed.

As shown in FIGS. 2 to 4, at the protrusion position P1, the planar antenna apparatus 1 can be prevented from being laterally inclined (in a width direction Y1) because the first rotating support leg 12A and the second rotating support leg 12B protrude from the first movable unit 30 when viewed in the direction parallel to the first axis C1.

As shown in FIG. 4, at the protrusion position P1, movements of the first rotating support leg 12A and the second rotating support leg 12B in opening directions are respectively restricted by the outer end 28Aa of the first guide hole 28A and the outer end 28Ba of the second guide hole 28B.

As shown in FIGS. 5 and 6, the movement of the first rotating support leg 12A in the closing direction is restricted because the locking protrusion tip 26Aa of the outer side locking protrusion 26A is locked in the locking piece 21Ca of the first outside restricting protrusion 21A. Similarly, the movement of the second rotating support leg 12B in the closing direction is restricted because the locking protrusion tip of the outer side locking protrusion is locked in the locking piece of the second outside restricting protrusion 21B. Therefore, the postures of the first rotating support leg 12A and the second rotating support leg 12B are maintained.

Figure 8:
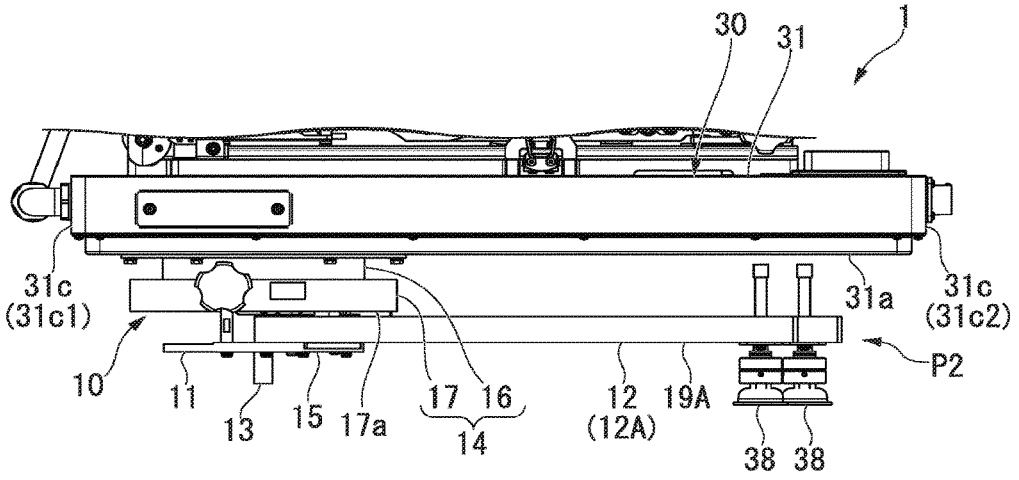
FIG. 8 is a side view showing a state where support legs are retracted in a planar antenna apparatus of one embodiment.
Figure 9:
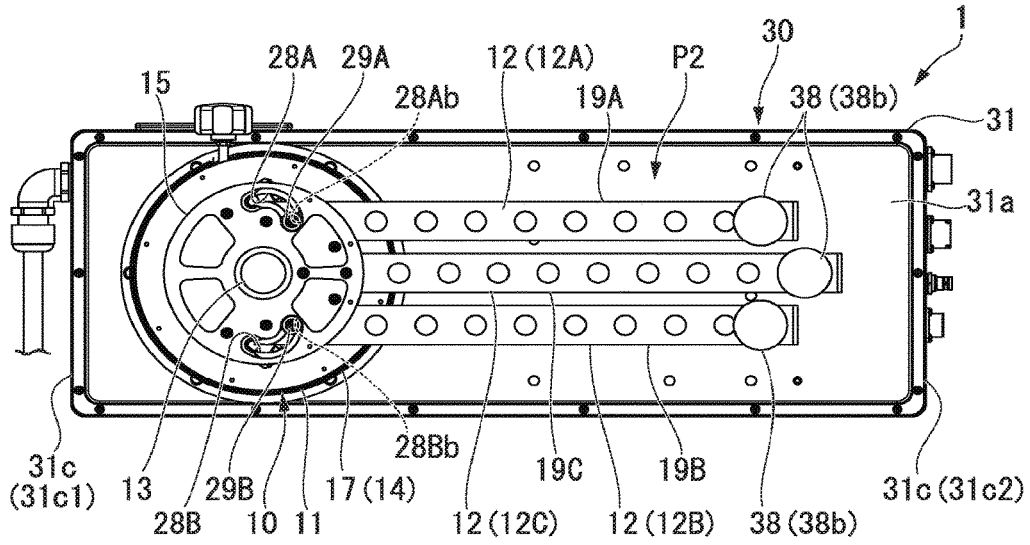
FIG. 9 is a plan view showing a state where support legs are retracted in a planar antenna apparatus of one embodiment.
Figure 10:
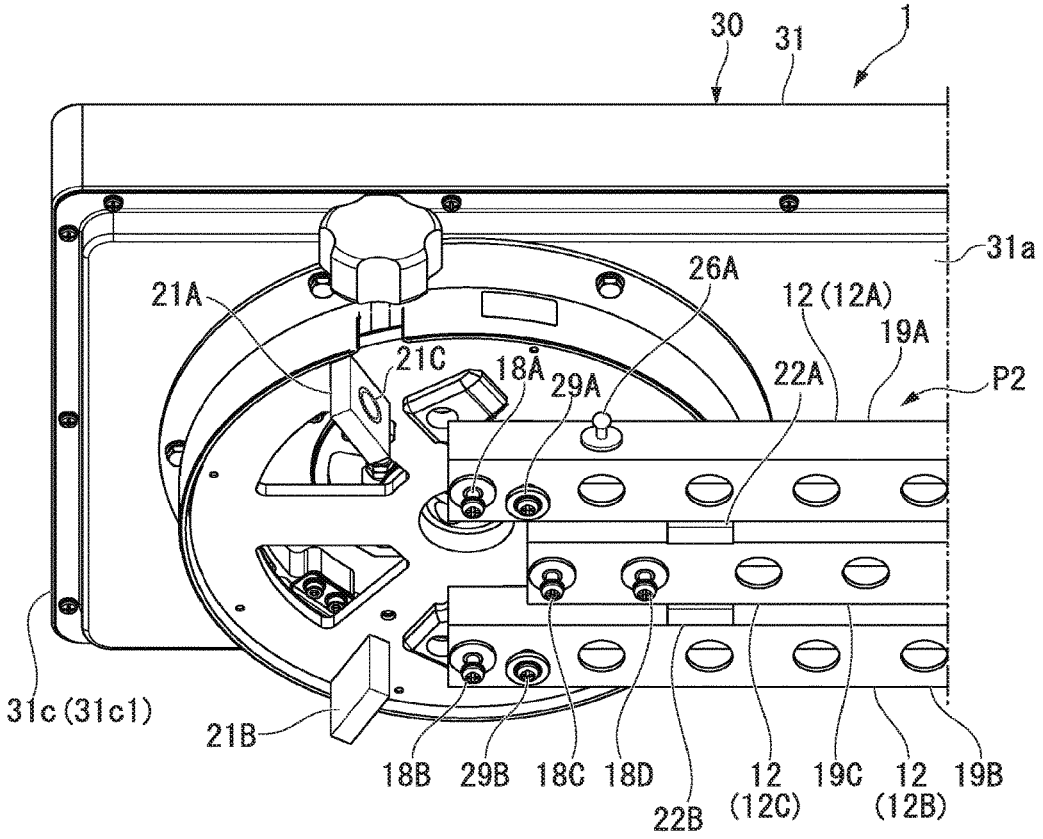
FIG. 10 is a perspective view showing an internal structure of a support in a state where support legs are retracted in a planar antenna apparatus of one embodiment.

As shown in FIGS. 8 to 10, at the retraction position P2, the first rotating support leg 12A and the second rotating support leg 12B become parallel to the fixed support leg 12C, all the support legs 12 are disposed in the contour of the first movable unit 30 when viewed in the direction parallel to the first axis C1, and thereby overall size can be reduced. Also, the planar antenna apparatus 1 can be easily handled with less protrusion.

As shown in FIG. 2, when the support legs 12 are at the retraction position P2, although all the grounding members 38 of the support legs 12 are gathered at one end side of a longitudinal direction X1, the planar antenna apparatus 1 can bring the tentative supporting protrusion 13 into contact with the installation surface 39 when the planar antenna apparatus 1 is tentatively placed at the installation surface 39 since the support 10 has the tentative supporting protrusion 13. Thus, an excessive force can be prevented from being applied to the support main body 11 and breakage can be prevented.

As shown in FIG. 9, at the retraction position P2, the movement of the first rotating support leg 12A and the second rotating support leg 12B in the closing directions is respectively restricted due to the inner end 28Ab of the first guide hole 28A and the inner end 28Bb of the second guide hole 28B.

The movement of the first rotating support leg 12A in the opening direction is restricted because the locking protrusion tip 26Ba of the inner side locking protrusion 26B (see FIGS. 5 and 6) is locked in a locking piece of the first inside restricting protrusion 22A. Similarly, also for the second rotating support leg 12B, the movement in the opening direction is restricted because the locking protrusion tip of the inner side locking protrusion is locked in the locking piece of the second inside restricting protrusion 22B. Thus, postures of the first rotating support leg 12A and the second rotating support leg 12B are maintained.

As shown in FIGS. 1 and 2, the first movable unit 30 has a housing 31 in a flat box shape and a guide 32 provided at a surface of the housing 31.

The first movable unit 30 has a function of converting signals (for example, high-frequency signals) received from the third movable unit 65 as needed and transferring the signals to a computer or the like, and a function of converting signals received from a computer or the like as needed and transferring the signals (for example, high-frequency signals) to the third movable unit 65. The first movable unit 30 has, for example, an intermediate frequency (IF) circuit section, a modulation-demodulation section or the like inside the housing 31. The first movable unit 30 is a so-called indoor unit (IDU).

The housing 31 is a cuboid having a bottom plate 31*a*, side plates 31*b* and 31*b*, end plates 31*c* and 31*c*, and a top plate 31*d*. The bottom plate 31*a* has a rectangular shape. The side plates 31*b* and 31*b* are erected on side edges of long sides of the bottom plate 31*a*. The end plates 31*c* and 31*c* are erected on end edges of short sides of the bottom plate 31*a*. The top plate 31*d* has the same shape as the bottom plate 31*a*. A thickness direction of the housing 31 is parallel to the first axis C1. X1 is a longitudinal direction of the bottom plate 31*a* and top plate 31*d*. Y1 is a width direction perpendicular to the longitudinal direction X1 in a plane along the bottom plate 31*a* and the top plate 31*d* (for example, a plane along a surface 31*d*1).

The housing 31 is rotatably supported around the first axis C1 with respect to the support 10.

When the housing 31 is viewed parallel to the first axis C1, the support 10 is positioned nearer to a first end 31*a*1 than to a center of the longitudinal direction X1 of the bottom plate 31*a*.

FIG. 3 is a perspective view showing the planar antenna apparatus 1 viewed from the front side in a state where members such as the antenna unit 70 or the like are removed.

As shown in FIG. 3, an insertion hole 35 into which the connection cable 80 is inserted is formed at the end plate 31*c* (an end plate 31*c*1) provided at the first end 31*a*1 in the longitudinal direction X1 of the bottom plate 31*a*.

The insertion hole 35 is formed at a position closer to a first end 31*e*1 than to a center of the end plate 31*c*1 in a width direction Y1.

An L-shaped cylindrical bent pipe 36 (a regulating member) into which the connection cable 80 which passes through the insertion hole 35 is inserted is provided at an outer surface of the end plate 31*c*1. When the connection cable 80 is inserted through the bent pipe 36, the connection cable 80 can be directed toward a direction close to a second end 31*e*2 along the width direction Y1.

Returning to FIG. 1, an input/output terminal 25 is provided at the end plate 31*c* (an end plate 31*c*2) provided at a second end 31*a*2 in the longitudinal direction X1 of the bottom plate 31*a*. The terminal 25 is connected to a computer which is not shown via a cable D1 therebetween. The planar antenna apparatus 1 is controlled by the computer.

On the surface 31*d*1 of the top plate 31*d*, a display 24 is provided at a position close to the end plate 31*c*2. The display 24 displays a measurement result of field intensity or the like.

The housing 31 can be provided in a sealable structure. Thereby, it is possible to provide a waterproofing property to the first movable unit 30.

Figure 11:
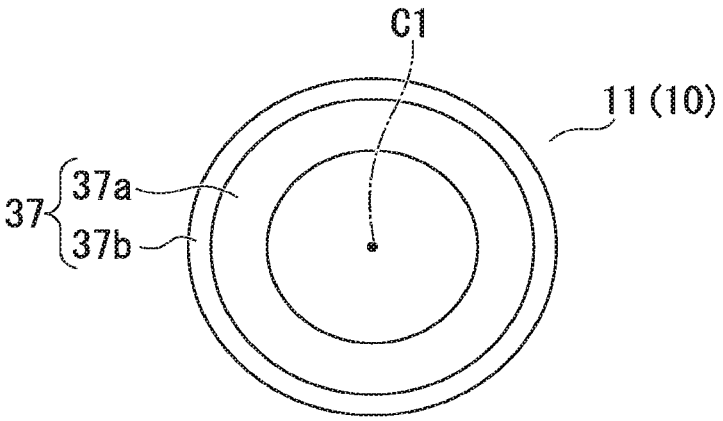
FIG. 11 is a plan view showing a first connector of a planar antenna apparatus of one embodiment.

FIG. 11 is a plan view showing a first connector of the planar antenna apparatus 1.

As shown in FIG. 11, the support 10 and the first movable unit 30 are connected, for example, by a first connector (connector) 37. The first connector 37 has, for example, an inner cylinder 37*a* in a cylindrical shape attached to the support main body 11 of the support 10 and an outer cylinder 37*b* in a cylindrical shape attached to the first movable unit 30. The outer cylinder 37*b* is coaxial with the inner cylinder 37*a* and surrounds the inner cylinder 37*a*. The first connector 37 is provided on the first axis C1. The outer cylinder 37*b* is movable only in a circumferential direction of the inner cylinder 37*a* with respect to the inner cylinder 37*a* using a well-known bearing mechanism or the like.

As shown in FIGS. 1 and 2, the guide 32 has a table 33 and a pair of rails 34. The table 33 is a rectangular plate-shaped body along the longitudinal direction X1 of the top plate 31*d* and is provided on the surface 31*d*1 (a main surface) of the top plate 31*d*. The rails 34 are provided on a surface of the table 33 along the longitudinal direction X1. The pair of the rails 34 are provided to be spaced from each other in the width direction Y1.

The second movable unit 40 roughly has a movable unit main body 41 formed in a plate shape and a blower 42.

The movable unit main body 41 has a main plate 41*a* and side plates 41*b* and 41*b* provided to protrude from an inner surface 41*a*1 side of the main plate 41*a* at side edges of the main plate 41*a* in a width direction.

The main plate 41*a* is formed in a rectangular shape (specifically, a rectangle).

At the side plate 41*b*, a through-hole 41*c* is formed at a position separate to a second end 41*b*2 side than to a first end 41*b*1 in a longitudinal direction.

The first end 41*b*1 of the side plate 41*b* is rotatably connected to a first end 33*a* of the table 33 of the first movable unit 30 via a shaft member 43 therebetween. Thereby, the second movable unit 40 is rotatable, with respect to the first movable unit 30, around a second axis C2 parallel to the surface 31*d*1 of the top plate 31*d* of the housing 31. The second axis C2 extends along the width direction Y1.

X2 is a longitudinal direction of the main plate 41*a* and the side plate 41*b*. The longitudinal direction X2 is the same as a direction in which the second movable unit 40 (specifically, the movable unit main body 41) extends from the second axis C2 toward a second connector 60 (described below). Y2 is a width direction in a plane along the main plate 41*a* and perpendicular to the longitudinal direction X2.

A first end 45*a* of a link member 45 is rotatably connected to the through-hole 41*c* of the side plate 41*b* of the second movable unit 40. A second end 45*b* of the link member 45 is rotatably connected to a traveling body 46 on the rails 34 of the first movable unit 30.

The traveling body 46 can travel along the rails 34 of the first movable unit 30 and is capable of being positioned at any position of the rails 34 in a length direction with respect to the rails 34.

The first movable unit 30, the second movable unit 40, the link member 45 and the traveling body 46 configured as above can adjust a support angle θ which is an angle around the second axis C2 of the second movable unit 40 with respect to the first movable unit 30 by moving the traveling body 46 along the rails 34.

The second axis C2 is a central axis of the shaft member 43. Also, the second axis C2 extends along the surface 31*d*1 of the top plate 31*d* of the housing 31.

An elevation angle adjuster 50 is engaged with the first movable unit 30 and the traveling body 46.

The elevation angle adjuster 50 includes an adjustment main body 51, a shaft-like member 52 having a male screw, and a handle 55 provided at an end of the shaft-like member 52.

The adjustment main body 51 can be positioned at any position of the table 33 in the longitudinal direction X1 with respect to the table 33. The male screw of the shaft-like member 52 is screwed into a female screw formed at an insertion hole 51*a* formed at the adjustment main body 51.

By rotating the handle 55 around the axis of the shaft-like member 52, the shaft-like member 52 moves in a longitudinal direction of the shaft-like member 52 with respect to the adjustment main body 51. When a position of the shaft-like member 52 in the longitudinal direction is changed, a position of the traveling body 46 in the longitudinal direction X1 can be adjusted according to the changed position of the shaft-like member 52. Thus, the support angle θ described above can be adjusted to an arbitrary angle.

The second movable unit 40 and the third movable unit 65 are connected by a second connector (connector) 60 configured similar to the first connector 37 described above. The second connector 60 is provided on a third axis C3 parallel to a thickness direction of the second movable unit 40. Thereby, the third movable unit 65 is rotatable around the third axis C3 with respect to the second movable unit 40.

The third movable unit 65 has a flat box-shaped housing 66.

The third movable unit 65 has functions of converting signals received from the antenna unit 70 as needed and transferring the converted signals (for example, high frequency signals) to the first movable unit 30, and converting signals received from the first movable unit 30 as needed and transferring the converted signals (for example, high frequency signals) to the antenna unit 70. The third movable unit 65 has, for example, a radio frequency (RF) circuit or the like inside the housing 66. The third movable unit 65 is a called outdoor unit (ODU).

As shown in FIGS. 2 and 3, the housing 66 has a bottom plate 66*a*, side plates 66*b* and 66*b*, end plates 66*c* and 66*c*, and a top plate 66*d*. The bottom plate 66*a* is rectangular. The side plate 66*b* is erected on a side edge which is a long side of the bottom plate 66*a*. The end plate 66*c* is erected on an end edge which is a short side of the bottom plate 66*a*.

A thickness direction of the housing 66 is parallel to the third axis C3. X3 is a longitudinal direction of the bottom plate 66*a* and the top plate 66*d*. Y3 is a width direction perpendicular to a longitudinal direction X3 in a plane along the bottom plate 66*a*.

The second movable unit 40 is connected to a surface 66*d*1 of the top plate 66*d* of the housing 66. Also, the third axis C3 extends in the thickness direction of the second movable unit 40.

A passage recess 67 is formed at a portion including a first end 66*e*1 at the top plate 66*d* of the housing 66. The passage recess 67 is formed in a concave shape in the thickness direction of the housing 66. A depth of the passage recess 67 is defined so that at least a portion of the connection cable 80 can pass therethrough.

The depth of the passage recess 67 can, for example, be the same as or deeper than an outer diameter of the connection cable 80. The depth of the passage recess 67 may be less than the outer diameter of the connection cable 80.

An insertion hole 68 through which the connection cable 80 is inserted is formed at one side of the side plates 66*b* of the housing 66. An L-shaped bent pipe 81 (a regulating member) through which the connection cable 80 which passes through the insertion hole 68 is inserted is provided at an outer side of the side plate 66*b* (see FIG. 3). By the connection cable 80 being inserted through the bent pipe 81, the connection cable 80 can be directed in the longitudinal direction X3.

A clamp 82 which grips the connection cable 80 is provided in the vicinity of the center in the longitudinal direction X3 of the one side of the side plates 66*b*. The clamp 82 can grip the connection cable 80 by sandwiching the connection cable 80 between a pair of grippers 82*a* and 82*a*.

Figure 12:
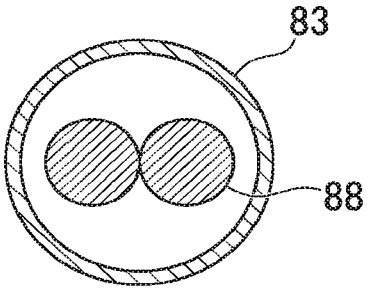
FIG. 12 is a cross-sectional view showing a connection cable of a planar antenna apparatus of one embodiment.

FIG. 12 is a cross-sectional view showing the connection cable 80.

As shown in FIG. 12, the connection cable 80 can be configured to include, for example, wirings 88 and a protective tube 83 which accommodates the wirings 88. The wirings 88 are a coaxial cable, for example. It is preferable that the wirings 88 can transmit high frequency signals. The protective tube 83 is a corrugate tube, for example.

As shown in FIG. 3, the connection cable 80 electrically connects the first movable unit 30 and the third movable unit 65. One end of the connection cable 80 reaches the inside of the first movable unit 30. The connection cable 80 passes through the insertion hole 35, is led to the outside of the housing 31 of the first movable unit 30, and is inserted into the bent pipe 36. The connection cable 80 is inserted into the bent pipe 81 via the clamp 82 provided at the third movable unit 65 and passes through the insertion hole 68 to reach the inside of the housing 66.

Figure 13:
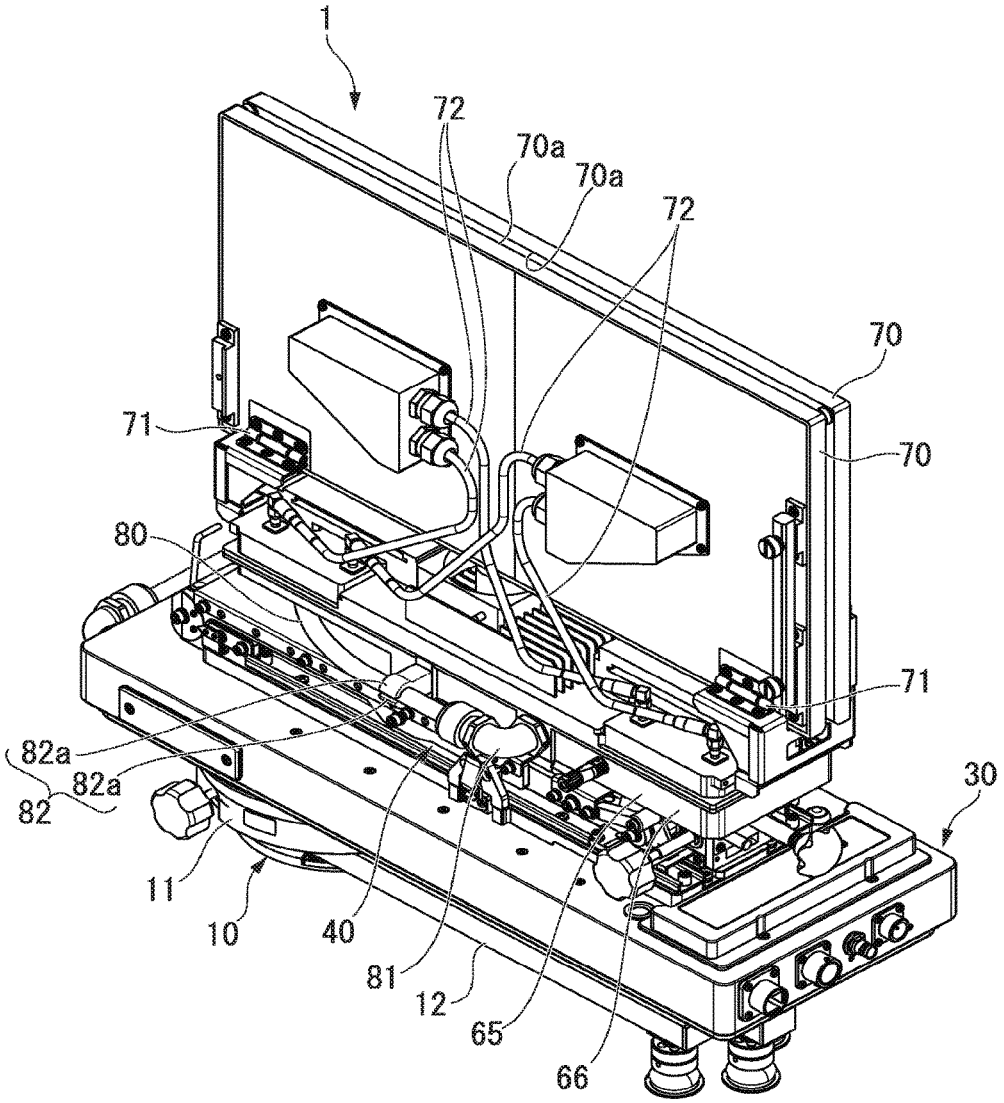
FIG. 13 is a perspective view showing a state where a planar antenna apparatus of one embodiment is folded.

As shown in FIGS. 1 and 13, a pair of the antenna units 70 and 70 formed in plate shapes can transmit and receive electromagnetic waves using a substrate that is not shown.

The housing 66 of the third movable unit 65 and the pair of the antenna units 70 are connected via a torque hinge 71. The torque hinge 71, for example, by adjusting torque generated between the housing 66 and the antenna unit 70, can tentatively retain the positions of the pair of antenna units 70 in a state of being disposed on the same plane (an opened state).

The pair of the antenna units 70 are switchable between a closed state where main surfaces 70*a* are disposed to face each other and the opened state where the main surfaces 70*a* are spread to be disposed on the same plane as shown in FIG. 1.

Each of the antenna units 70 is connected to the third movable unit 65 by an auxiliary wiring 72.

As shown in FIG. 2, an elevation angle (EL) $\alpha$ of the antenna unit 70 is determined on the basis of a position of a communication satellite or the like. Typically, the elevation angle $\alpha$ is an angle less than 90°, for example, in a range of 20 to 70°. The antenna unit 70 is configured so that the elevation angle $\alpha$ is set to an arbitrary value in the range.

Here, in the present embodiment, a minimum value of the elevation angle allowable for a planar antenna apparatus to use (here, 20°) will be described as a "minimum use angle" and a maximum value of the elevation angle allowable for a planar antenna apparatus to use (here, 70°) will be described as a "maximum use angle".

The support angle $\theta$ which is an angle of the second movable unit 40 with respect to the first movable unit 30 (for example, an angle of the main plate 41*a* with respect to the surface 31*d*1 of the top plate 31*d*) is the same as the elevation angle $\alpha$, for example, in a range of 20° to 70°.

As shown in FIG. 7, it is preferable that, a center of gravity G1 of the whole planar antenna apparatus 1 when the elevation angle $\alpha$ (see FIG. 2) of the antenna unit 70 is set to 20° which is the minimum use angle be aligned with a center of gravity G2 of a triangle T1 connecting a center of the grounding member 38 of the three support legs 12 when viewed perpendicular to a horizontal plane (the installation surface 39). Here, in order to prevent the planar antenna from falling easily, it is preferable that the angles of the grounding member 38 of the support legs 12 form an equilateral triangle.

The elevation angle $\alpha$ of the antenna unit 70 as shown in FIG. 2 is an angle formed by a line perpendicular to a main surface 70*a* of the antenna unit 70 with respect to a horizontal plane HI. Thus, when the elevation angle $\alpha$ is 20° which is the minimum use angle, an angle of the planar antenna unit 70 becomes 70° (90° minus 20°), which is easily influenced by the wind when installed. In contrast, when the elevation angle $\alpha$ is 70° which is the maximum use angle, the angle of the antenna unit 70 becomes 20° (90° minus 70°), which is relatively close to the horizontal and is not easily influenced by the wind. Thus, in the planar antenna apparatus 1 according to the present embodiment, it is preferable that the center of gravity G1 of the whole apparatus in the case that the elevation angle $\alpha$ is the minimum use angle which is a condition that is most susceptible to the influence of the wind when installed outdoors be aligned with the center of gravity G2 of the triangle T1 connecting the center of the grounding member 38 of the support legs 12.

Also, when number of support legs 12 is four or more, a center of gravity of an entire body planar antenna apparatus needs to be aligned with a center of gravity of a polygon (with four or more angles) connecting grounding members (grounding points) of support legs when viewed perpendicular to the horizontal plane (the installation surface 39).

Aligning the center of gravity G1 of the whole planar antenna apparatus 1 with the center of gravity G2 of the triangle T1 when viewed perpendicular to the horizontal plane (the installation surface 39) can be explained, for example, as follows. A reference polygon T2 (a polygon connecting grounding points of the support legs) is assumed that a center of gravity thereof is the same as the center of gravity G2 of the triangle T1 and a shape thereof is similar to the triangle T1 with a similarity ratio of one-tenth. When viewed perpendicular to the horizontal plane (the installation surface 39), if the center of gravity G1 is within a range of the reference polygon T2, the center of gravity G1 and the center of gravity G2 are considered to be aligned.

The planar antenna apparatus 1 can be stably installed without being inclined under the influence of wind or the like even when used outdoors because the center of gravity G1 with the elevation angle α of the antenna unit 70 set to 20° is aligned with the center of gravity G2 of the triangle T1 connecting the grounding member 38 of the three support legs 12 when viewed perpendicular to the horizontal plane (the installation surface 39).

Next, a procedure for setting the planar antenna apparatus 1 as above will be described below.

Figure 14:
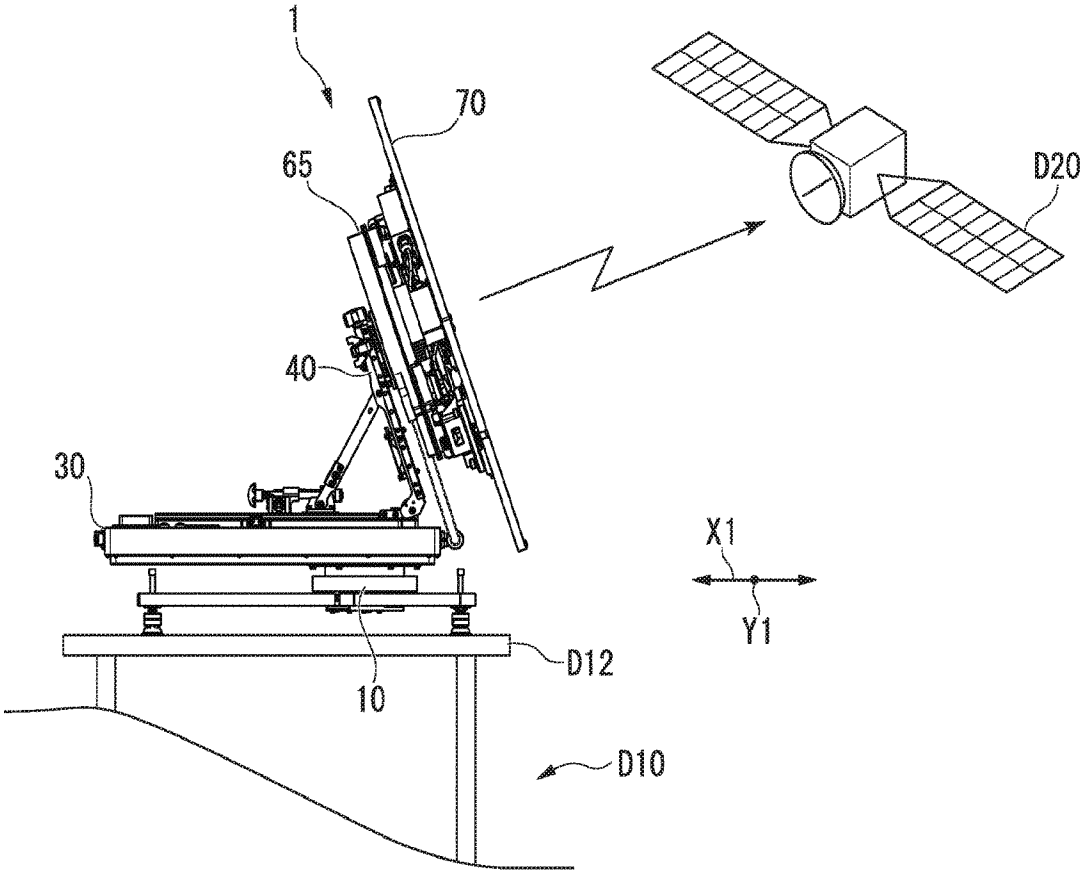
FIG. 14 is a view showing a state where a planar antenna apparatus of one embodiment is installed.

FIG. 14 is a view in a state where the planar antenna apparatus 1 is installed. As shown in FIG. 14, a support table D12 is installed so that a top surface becomes horizontal, for example, at a destination site D10 of a disaster area or the like. A pair of the support legs 12 protrude and the support 10 of the planar antenna apparatus 1 is placed on the top surface of the support table D12.

An azimuth (AZ), an elevation angle (EL) and a polarization angle (POL) are obtained in advance from latitude and longitude of the destination site D10, a position of a targeted communication satellite D20 or the like.

An elevation angle is roughly set and the pair of the antenna units 70 are switched from the closed state to the opened state. Since the pair of the antenna units 70 and the housing 66 of the third movable unit 65 are connected via the torque hinge 71, each of the antenna units 70 is tentatively retained in the opened state.

For example, the planar antenna apparatus 1 is directed in a southeast direction after detecting the southeast direction using a compass or the like. A computer and the planar antenna apparatus 1 are connected via the cable D1. The planar antenna apparatus 1 starts to operate.

By operating the computer, field intensity of electromagnetic waves received by the pair of the planar antenna apparatus 1 and measured by the first movable unit 30 is displayed on the display 24. An angle around the first axis C1 of the first movable unit 30 with respect to the support 10, that is, the azimuth, is adjusted so that the field intensity increases while the field intensity being displayed on the display 24 is checked.

The polarization angle is adjusted by rotating the third movable unit 65 around the third axis C3 with respect to the second movable unit 40.

The planar antenna apparatus 1 set as above communicates with the communication satellite D20.

According to the planar antenna apparatus 1 of the present embodiment, the first movable unit 30 is rotatable with respect to the support 10, the second movable unit 40 is rotatable with respect to the first movable unit 30, and the third movable unit 65 is rotatable with respect to the second movable unit 40. Further, the pair of antenna units 70 are switchable between the closed state and the opened state.

Since the planar antenna apparatus 1 in a folded state is small in shape compared to the planar antenna apparatus 1 in a set state, it is easy to carry the planar antenna apparatus 1.

By expanding the planar antenna apparatus 1 from the folded state and adjusting the azimuth, the elevation angle and the polarization angle, it is possible to easily set the planar antenna apparatus 1 without needing to assemble the planar antenna apparatus 1.

According to at least one embodiment described above, since the center of gravity G1 of the planar antenna apparatus 1 with the elevation angle α of the antenna unit 70 set to 20° is aligned with the center of gravity G2 of the triangle T1 connecting the grounding member 38 of the three support legs 12 when viewed perpendicular to the horizontal plane (the installation surface 39), the planar antenna apparatus 1 can be stably installed without being inclined under the influence of wind or the like even when used outdoors.

While preferred embodiments of the present invention have been described, it should be understood that these embodiments are exemplary of the invention and are not to be considered as limiting the scope of the invention. The embodiments may be implemented in many other different forms, and various omissions, substitutions, and other modifications can be made without departing from the spirit or scope of the invention. The embodiments and modifications thereof should be regarded as being included within the scope and spirit of the invention and included in the invention described in the claims and equivalent scope thereof.

What is claimed is:

1. A planar antenna apparatus comprising:

a support comprising: a support main body, and three or more support legs extending from the support main body;

a first movable unit rotatably supported around a first axis with respect to the support;

a second movable unit rotatably supported around a second axis with respect to the first movable unit, the second axis extending along a main surface of the first movable unit;

a third movable unit rotatably supported around a third axis with respect to the second movable unit, the third axis extending along a thickness direction of the second movable unit;

an antenna unit supported by the third movable unit; and a connection wire electrically connecting the first movable unit and the third movable unit, wherein, when an elevation angle of the antenna unit is set to a minimum use angle, a center of gravity of an entire body including the support, the first movable unit, the second movable unit, the third movable unit, the antenna unit, and the connection wire is aligned with a center of gravity of a polygon which connects a grounding point of the three or more support legs when viewed perpendicular to an installation surface with which the support legs are in contact.

2. The planar antenna apparatus according to claim 1, wherein at least two of the support legs are rotatably supported around a rotating shaft parallel to the first axis with respect to the support main body to be switchable between a protrusion position and a retraction position, the protrusion position is a position in which at least two of the support legs protrude from the first movable unit when viewed in the direction parallel to the first axis, and the retraction position is a position in which at least two of the support legs are disposed in a contour of the first movable unit when viewed in the direction parallel to the first axis.

3. The planar antenna apparatus according to claim 2, wherein the rotatable support legs are parallel to each other at the retraction position when viewed in the direction parallel to the first axis.

4. The planar antenna apparatus according to claim 2, wherein one of the support legs is a fixed support leg disposed in the contour of the first movable unit when viewed in the direction parallel to the first axis, and the fixed support leg is fixed at the support main body, the rotatable support legs are a first rotating support leg and a second rotating support leg, the first rotating support leg protrudes to one side of the first movable unit at the protrusion position, and the second rotating support leg protrudes to the other side of the first movable unit at the protrusion position.

5. The planar antenna apparatus according to claim 2, further comprising:

a protrusion retention mechanism configured to retain the rotatable support legs at the protrusion position, wherein the protrusion retention mechanism comprises: a locking protrusion provided at one side of the support legs or the support main body, and a lock receiver provided at the other side of the support legs or the support main body so that the locking protrusion is releasably locked.

6. The planar antenna apparatus according to claim 2, further comprising:

a retraction retention mechanism configured to retain the rotatable support legs at the retraction position, wherein the retraction retention mechanism comprises: a locking protrusion provided at one side of the support legs or the support main body, and a lock receiver provided at the other side of the support legs or the support main body so that the locking protrusion is releasably locked.

7. The planar antenna apparatus according to claim 2, wherein the support main body comprises a tentative supporting protrusion which is contactable with the installation surface when the rotatable support legs are disposed at the retraction position.

8. A support of a planar antenna apparatus usable in a planar antenna apparatus comprising a first movable unit, a second movable unit, a third movable unit, an antenna unit, and a connection wire, the support comprising:

a support main body and three or more support legs extending from the support main body, wherein at least two of the support legs are rotatably supported around a rotating shaft parallel to a first axis with respect to the support main body to be switchable between a protrusion position in which at least two of the support legs protrude from the first movable unit and a retraction portion in which at least two of the support legs are disposed in a contour of the first movable unit when viewed in the direction parallel to the first axis, and wherein the first movable unit is rotatably supported around the first axis with respect to the support, the second movable unit is rotatably supported around a second axis with respect to the first movable unit, the second axis extending along a main surface of the first movable unit, the third movable unit is rotatably supported around a third axis with respect to the second movable unit, the third axis extending along a thickness direction of the second movable unit, the antenna unit is supported by the third movable unit, the connection wire electrically connects the first movable unit and the third movable unit, and when an elevation angle of the antenna unit is set to a minimum use angle, a center of gravity of an entire body including the support, the first movable unit, the second movable unit, the third movable unit, the antenna unit, and the connection wire is aligned with a center of gravity of a polygon which connects a grounding point of the three or more support legs when viewed perpendicular to an installation surface with which the support legs are in contact.

9. The support according to claim 8, wherein the rotatable support legs are parallel to each other at the retraction position when viewed in the direction parallel to the first axis.

10. The support according to claim 8, wherein the support legs include a fixed support leg disposed in the contour of the first movable unit when viewed in the direction parallel to the first axis and being fixed at the support main body, and the rotatable support legs include a first rotating support leg which protrudes to one side of the first movable unit at the protrusion position and a second rotating support leg which protrudes to the other side of the first movable unit at the protrusion position.

11. The support according to claim 8, further comprising a protrusion retention mechanism which retains the rotatable support legs at the protrusion position, wherein the protrusion retention mechanism has a locking protrusion provided at one side of the support legs or the support main body, and a lock receiver provided at the other side of the support legs or the support main body so that the locking protrusion is releasably locked.

12. The support according to claim 8, further comprising a retraction retention mechanism which retains the rotatable support legs at the retraction position, wherein the retraction retention mechanism has a locking protrusion provided at one side of the support legs or the support main body, and a lock receiver provided at the other side of the support legs or the support main body so that the locking protrusion is releasably locked.

13. The support according to claim 8, wherein a tentative supporting protrusion which is contactable with the installation surface when the rotatable support legs are disposed at the retraction position is formed at the support main body.

* * * * *